United States Patent [19]

Schroeder

[11] 4,126,143

[45] Nov. 21, 1978

[54] ELECTRICALLY HEATED COMB FOR HAIR STYLING

[75] Inventor: George A. Schroeder, Chicago, Ill.

[73] Assignee: Johnson Products Co., Inc., Chicago, Ill.

[21] Appl. No.: 789,117

[22] Filed: Apr. 20, 1977

[51] Int. Cl.[2] ..... A45D 24/00

[52] U.S. Cl. ..... 132/11 A; 132/37 R

[58] Field of Search ..... 132/9, 11, 36–37, 132/118, 162, 153, 142

[56] References Cited

U.S. PATENT DOCUMENTS

| | | | |
|---|---|---|---|
| 959,866 | 5/1910 | Keefe | 132/118 |
| 2,761,460 | 9/1956 | Egan, Jr. | 132/142 |
| 3,416,543 | 12/1968 | Hantman | 132/11 R |
| 3,927,684 | 12/1975 | Lam | 132/11 R |

*Primary Examiner*—G.E. McNeill

*Attorney, Agent, or Firm*—Dressler, Goldsmith, Clement, Gordon & Shore, Ltd.

[57] ABSTRACT

An electrically heated comb for hair styling and straightening is disclosed which heats each hank of hair on two sides for quick and effective drying and styling of the hair. The comb has a row of heat conducting teeth and insulated protective teeth, all of which are connected to a heat conducting element that extends outwardly from a handle. At least portions of two heat conducting teeth are provided in the space between immediately adjacent protective teeth. Each of the two heat conducting teeth has only one exposed heating surface within the aforesaid space.

13 Claims, 6 Drawing Figures

ELECTRICALLY HEATED COMB FOR HAIR STYLING

BACKGROUND OF THE INVENTION

This invention relates to electrically heated combs for styling hair.

Electrically heated combs have been devised for applying heat to the hair while combing the hair, thereby enabling a user to style and straighten the hair as desired. One of the problems with such combs is providing sufficient heat with a heating element for drying the hair, while preventing the heating element from contacting and burning the scalp.

One attempt at solving this problem is shown in U.S. Pat. No. 3,760,821 to Weddington which discloses a heated hair comb having alternating heating teeth and unheated combing teeth, all of which are mounted on a handle. There is a space between every pair of adjacent teeth, and one heating tooth is centrally positioned between every pair of unheated combing teeth. A device generally in accordance with the principle of the Weddington patent is manufactured by Dallas Products, Inc. and distributed by McCurry International, Inc. of Irving, Tex.

It is a disadvantage of the Weddington patent, and combs which embody its teachings, that individual hank of hair are positioned between one heating tooth and one unheated protective tooth. Thus, the hair is heated substantially on only one side.

SUMMARY OF THE INVENTION

The disadvantage of prior art electrically heated combs are overcome by the present invention in which each hank of hair is heated on two sides for quicker and more effective drying and styling. This is accomplished by providing at least portions of two heat conducting teeth in the space between each pair of immediately adjacent protective teeth. Only one exposed heating surface of each of the two heat conducting teeth is located within the aforesaid space.

According to the present invention, an electrically heated comb for styling hair has a handle, a heat conducting element which extends outwardly from the handle, and a row of teeth which are carried by the handle and extend outwardly therefrom. The teeth include heat conducting teeth and non-heat-conducting protective or insulated teeth. The teeth have a predetermined thickness along the longitudinal axis of the comb, a length corresponding to the distance that the teeth protrude outwardly from the heat conducting element, and a width. The protective teeth are longer and wider than the heat conducting teeth to protect the scalp of the user from the heat.

In the preferred embodiment, there is a single row of heat conducting teeth and protective teeth.

In one embodiment a second row of protective teeth is provided. The protective teeth in the second row are shorter than the protective teeth in the first row and are helpful for combing thick, coarse or snarled hair.

In another embodiment, two rows of teeth are provided, with each row including protective teeth and heat conducting teeth. The teeth in one row are longer than the teeth in the other row to give the user a choice of the size of teeth to be used for combing and styling the hair.

DETAILED DESCRIPTION OF THE DISCLOSED EMBODIMENTS

Figures 1, 2, 3, 4, 5, 6, 7:
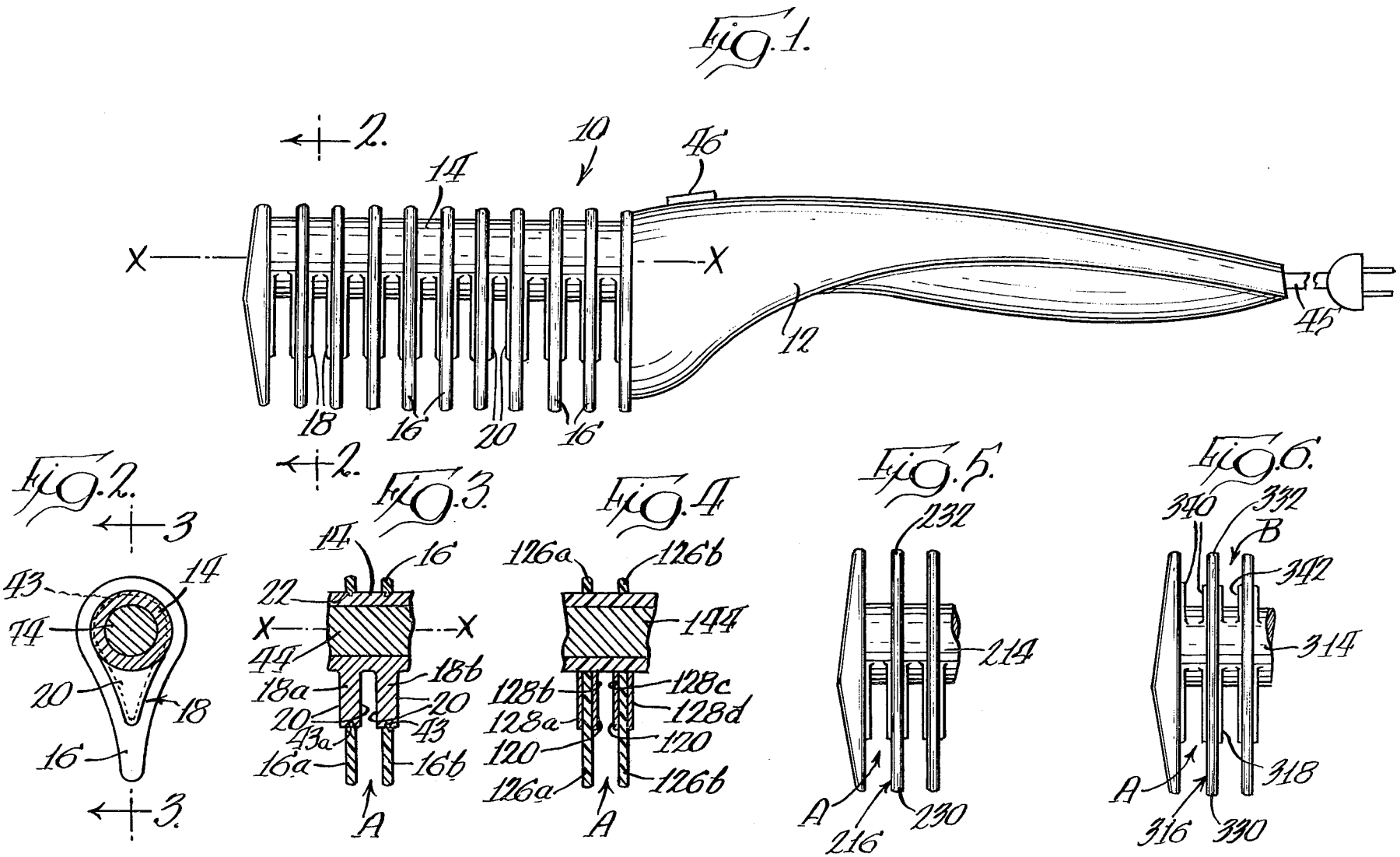
FIG. 1 is a side elevational view of an electrically heated comb for hair styling in accordance with the present invention.
FIG. 2 is a cross-sectional view taken along plane 2—2 in FIG. 1.
FIG. 3 is a fragmentary cross-sectional view taken along plane 3—3 in FIG. 2.
FIG. 4 is a fragmentary cross-sectional view, similar to FIG. 3, and showing another embodiment of the invention.
FIG. 5 is a fragmentary side-elevational view, similar to a portion of FIG. 1, and showing another embodiment of the invention.
FIG. 6 is a fragmentary side-elevational view, similar to FIG. 5, showing still another embodiment of the present invention.

In the following description, two digit numerals are used to refer to the embodiment illustrated in FIGS. 1–3, three digit numerals in the one hundred series are used to refer to the embodiment illustrated in FIG. 4, three digit numerals in the two hundred series are used to refer to the embodiment illustrated in FIG. 5, and three digit numerals in the three hundred series are used to refer to the embodiment illustrated in FIG. 6.

Referring first to FIG. 1, an electrically heated comb 10 for styling and straightening hair in accordance with the present invention includes a handle 12 for holding the comb, and a heat conducting element 14 which is secured to the handle and extends outwardly from the handle. The comb also includes a plurality of spaced apart unheated protective teeth 16 and a plurality of spaced apart heat conducting teeth 18. The protective teeth 16 are carried by either handle 12 or the heat conducting element 14 and, as shown in FIG. 1, are preferably carried by the heat conducting element 14. The heat conducting teeth 18 are also carried by heat conducting element 14, and can be integral therewith or mounted thereto.

The unheated protective teeth 16 and the heat conducting teeth 18 are aligned in a row. Teeth 18 conduct heat for the purpose of drying and styling hair, and could damage the scalp of the user if positioned too close to the skin while at an elevated operating temperature. Consequently, in accordance with the present invention, each of said unheated protective teeth 16 projects outwardly in all directions in the median plane of said tooth 16 a greater distance than the immediately adjacent heat conducting teeth 18, as best shown in FIG. 2. The protective teeth protect the scalp by keeping the heating teeth away from the scalp by a predetermined distance.

Each heat conducting tooth 18 has at least one exposed heating surface 20. As shown in FIG. 3, at least a portion of two heat conducting teeth **18*a* and 18*b* is positioned in the space A between each pair of immediately adjacent protective teeth 16*a* and 16*b*. However, each of the two heat conducting teeth 18*a* and 18*b* located in the space A between immediately adjacent protective teeth 16*a* and 16*b* has only one exposed heating surface 20** located within the aforesaid space A.

The preferred embodiment which accomplishes the foregoing result is shown in section in FIG. 3. Each protective tooth **16*a* and 16*b* has an aperture 22 extending therethrough in the axial direction $x—x$ of the comb, and one of the heat conducting teeth such as 18***a* or 18*b* is positioned within each of the apertures 22. Each conducting tooth has a thickness greater than its associated protective tooth and thereby extends into the space on either side of the protective tooth. Thus, only one exposed surface 20 of each of the two heat conducting teeth 18*a* and 18*b* is positioned in the space A between each pair of immediately adjacent protective teeth 16*a* and 16*b*.

Another structure for positioning just one exposed surface of each of two heat conducting teeth between each pair of immediately adjacent protective teeth is shown in FIG. 4. Protective teeth 126*a* and 126*b* are similar to the corresponding teeth 16*a* and 16*b* in FIG. 3, but whereas the protective teeth shown in FIG. 3 have apertures 22 extending therethrough protective teeth 126*a* and 126*b* shown in FIG. 4 are not so apertured. A pair of conducting teeth are immediately juxtaposed to the opposing faces of each protective tooth, with each protective tooth projecting outwardly in all directions in the median plane of the protective tooth a greater distance than the immediately adjacent heat conducting teeth. Thus, conducting teeth 128*a* and 128*b* are juxtaposed to, and in contact with, the opposing faces of protective tooth 126*a*, and conducting teeth 128*c* and 128*d* are similarly immediately juxtaposed to and in contact with protective tooth 126*b*. Consequently, the pair of immediately adjacent protective teeth 126*a* and 126*b* have a pair of heat conducting teeth 128*b* and 128*c* positioned in the space A therebetween, with only one of the exposed heating surfaces 120 of the heat conducting teeth being located in space A. Each heat conducting tooth has one exposed heating surface 120, and an opposite surface which preferably is flush with a protective tooth.

Although the protective teeth shown in FIGS. 1 through 4 surround the heat conducting element 14, they extend outwardly from the heat conducting element by a significant amount only in one direction. Likewise, the heat conducting teeth extend outwardly from the heat conducting element in only one direction and they are aligned with the protective teeth. As shown in FIGS. 5 and 6, however, the protective teeth may extend outwardly from the heat conducting element 14 by a significant amount in more than one direction so as to provide a second row of teeth.

Referring specifically to FIG. 5, each protective tooth 216 has a first portion 230 protruding outwardly from heat conducting element 214 in the same manner as shown and described in FIGS. 1–3. In addition, each protective tooth 216 has a second portion 232 protruding outwardly from the heat conducting element 214 in a direction opposite to portion 230 of the protective tooth. Portions 230 and 232 of the protective teeth 216 define two pluralities of protective teeth which are aligned in two separate rows. Each row of protective teeth is mounted to the heat conducting element 214 and comprises opposing projecting portions of the protective teeth 216. Portions 232 of protective teeth 216 project outwardly from the heat conducting element 214 a lesser distance than the portions 230 of the protective teeth, so as to provide a choice to the user as to the length of protective teeth which is desired.

The embodiment shown in FIG. 6 is similar to the embodiment of FIG. 5, but in addition to the second row of protective teeth 332, further includes a second plurality of heat conducting teeth 340 aligned with the protective teeth 332 in a row. Protective teeth 332 project outwardly from heat conducting element 314 a greater distance than heat conducting teeth 340. Except for the dimensions of the teeth, protective teeth 332 and heat conducting teeth 340 are arranged in the same way as protective teeth 330 and heat conducting teeth 318 with each pair of immediately adjacent protective teeth 332 having at least portions of two heat conducting teeth 340 in the space B therebetween, with only one exposed heating surface 342 of each of the two heat conducting teeth 340 being located within space B.

The arrangement shown in FIG. 5 provides long teeth for heating and styling hair, and shorter teeth which can be used only for styling hair. The shorter teeth are useful for unsnarling tangled hair. The arrangement shown in FIG. 6, having two rows of teeth with protective teeth and conducting teeth in each row, and with the protective teeth in the two rows having different lengths, permits a user to determine which row of teeth should be used for heating and styling the hair. The longer teeth can be used for longer hair, and the shorter teeth can be used for shorter hair or hair which is more difficult to comb.

All of the foregoing embodiments have the important feature that at least portions of two heat conducting teeth are positioned in the space between each pair of immediately adjacent protective teeth, and only one exposed heating surface on each of the two heat conducting teeth is located within the space. With this arrangement, each hank of hair contained between a pair of immediately adjacent heat conducting teeth is always heated on two sides. The hair receives heat from the exposed heating surfaces of the two heat conducting teeth positioned between every pair of immediately adjacent protective teeth. This is a significant improvement over prior art devices in which the protective teeth and the heating teeth alternate so that a hank of hair is received between one protective tooth and one heating tooth and only receives heat on one side of the hair. This invention is superior because hair is dried and styled faster and more effectively. One of the reasons why this invention achieves a superior result is that by providing at least portions of two heat conducting teeth between each pair of protective teeth, there can be a greater mass of heat conducting material between the protective teeth, and the greater the mass of heat conducting material, the greater the heat transfer capability.

In all of the embodiments, protective teeth preferably are positioned at both ends of each row of teeth.

In this invention, the heat conducting teeth are formed of a heat conducting material, such as aluminum, and are desirably integral with the heat conducting element (FIG. 3) which is formed of the same material. Alternatively, the heat conducting teeth can be mounted to the heat conducting element.

The protective teeth are formed of a heat insulative material, such as plastic, which is resistant to the typical operating temperatures of about 250° F. to about 380° F., and to the chemicals used on hair in combination with the heated comb. The material of which the protective teeth are made should also be dimensionally stable under the extreme temperature changes to which the heated comb is subjected. The plastic protective teeth can be molded about the heat conducting element, and for this reason they are illustrated as surrounding the heat conducting element. This arrangement increases the strength and integrity of the protective teeth. To prevent relative movement between the protective teeth 16 and the heat conducting teeth 18, each protective tooth is provided with a recess 43 about it its periphery and each heat conducting tooth has a corresponding locating rib 43*a* about is periphery which is receivable in the recess 43, as shown in FIGS. 2 and 3. Alternatively, pins could be used to mount the teeth to the heat conducting element.

According to a further feature of the invention, in all of the embodiments, the protective teeth and heat conducting teeth are provided with a surface coating of a suitable material which has non-stick properties on the exposed surface at elevated temperatures up to about 380° F., such as the plastic material sold under the trademark Teflon. Such a coating provides greater ease of combing than the bare aluminum heat conducting teeth or plastic protective teeth would otherwise permit.

As shown in FIGS. 1 and 2, heat conducting element 14 is generally cylindrical and hollow. Protruding outwardly from handle 12 is a heat generating and sensing element 44 which is receivable in the heat conducting element 14. Element 44 preferably comprises a controllable thermostat which is surrounded by a heat generating element such as a silicone rubber heater. An electric cord 45 is connected to a source of electrical energy, and a pair of insulated wires which extend into the handle 12. A temperature adjusting knob 46 is provided for adjusting the temperature of the heat conducting teeth within the preferred operating range of about 250° F. to about 380° F. Heat is transferred to the heat conducting teeth 18 via the heat conducting element 14 and element 44.

The above detailed description of this invention has been given for ease of understanding only. No unnecessary limitations should be understood therefrom, as modifications will be obvious to one skilled in the art.

I claim:

1. A heated hair comb comprising:

a handle, a heat conducting element secured to said handle and extending outwardly therefrom, said heat conducting element having an outer surface;

a plurality of spaced apart unheated protective teeth carried by one of said handle and said heat conducting element; and a plurality of spaced apart heat conducting teeth carried by said heat conducting element, each of said heat conducting teeth having at least one exposed heating surface, wherein said protective teeth and said heat conducting teeth are aligned in a row along the longitudinal axis of said comb and project outwardly from said heat conducting element, with each of said protective teeth projecting outwardly in all directions in the median plane of said protective tooth a greater distance than immediately adjacent ones of said heat conducting teeth, each pair of immediately adjacent protective teeth having at least portions of two of said heat conducting teeth positioned in the space between them, with only one of the exposed heating surfaces of each of said two heat conducting teeth being located within said space, and wherein segments of said heat conducting element comprise the outside surface of said comb between said two heat conducting teeth which are positioned in the space between each pair of immediately adjacent protective teeth, said outer surface of said heat conducting element defining said outside surface of said comb about the entire periphery of each said segment of said heat conducting element, whereby each hank of hair positioned between an adjacent pair of said heat conducting teeth when the comb is in use receives heat from an exposed heating surface of said heat conducting teeth on both sides of said hanks of hair and segments of said heat conducting element are exposed about the entire periphery of said heat conducting element for transmitting heat to hair when the comb is in use.

2. A heated hair comb as defined in claim 1 wherein said two heat conducting teeth positioned within said space between a pair of protective teeth are immediately juxtaposed to opposing faces of said pair of protective teeth.

3. A heated hair comb as defined in claim 1 wherein each of said protective teeth has an groove extending therethrough in the direction of the longitudinal axis of said comb, and wherein one of said heat conducting teeth is positioned within each of said apertures, said one heat conducting tooth having a thickness greater than its associated protective tooth and thereby extending into the space on either side of said protective tooth.

4. A heated hair comb as defined in claim 1 wherein one of said protective teeth is positioned at each end of said row.

5. A heated hair comb as defined in claim 1 wherein said heat conducting teeth are integral with said heat conducting element.

6. A heated hair comb as defined in claim 1 wherein said heat conducting teeth are mounted to said heat conducting element.

7. A heated hair comb as defined in claim 1 wherein said heat conducting element is generally cylindrical and is hollow.

8. A heated hair comb as defined in claim 1 wherein said protective teeth are a first plurality of protective teeth and said heat conducting teeth are a first plurality of heat conducting teeth together defining a first row of teeth, and a second plurality of protective teeth is carried by said heat conducting element to define a second row of teeth, said second plurality of protective teeth projecting outwardly in the opposite direction from said heat conducting element a lesser distance than said first plurality of protective teeth.

9. A heated hair comb as defined in claim 8 wherein a second plurality of heat conducting teeth is carried by said heat conducting element and is aligned in said second row with said second plurality of protective teeth, said second plurality of protective teeth projecting outwardly a greater distance from said heat conducting element than said second plurality of heat conducting teeth, each pair of immediately adjacent protective teeth in said second row having at least portions of two of said heat conducting teeth in said second row positioned in the space between them, with only one of the exposed heating surfaces of each of said two heat conducting teeth in said second row being located within said space, whereby each hank of hair positioned between an adjacent pair of heat conducting teeth in either of said rows of teeth receives heat from an exposed heating surface of said heat conducting teeth on both sides of said hair when the comb is in use.

10. A heated hair comb as defined in claim 1 wherein said heat conducting teeth and protective teeth are coated with a material whose exposed surface has non-stick properties to provide greater ease of combing.

11. A heated air comb as defined in claim 1 wherein said comb further includes temperature adjusting means for adjusting the temperature of the heat conducting teeth between about 250° F. and about 380° F.

12. A heated hair comb as defined in claim 1 wherein the mass of said heat conducting element is greater than the collective mass of said heat conducting teeth.

13. A heated hair comb comprising:

a handle, a heat conducting element secured to said handle and extending outwardly therefrom, said heat conducting element having an outer surface;

a plurality of spaced apart unheated protective teeth carried by one of said handle and said heat conducting element; and a plurality of spaced apart heat conducting teeth carried by said heat conducting element and integral with said heat conducting element, each of said heat conducting teeth having at least one exposed heating surface;

said heat conducting element having a greater mass than the collective mass of said heat conducting teeth;

wherein said protective teeth and said heat conducting teeth are aligned in a row along the longitudinal axis of said comb and project outwardly from said heat conducting element, with each of said protective teeth projecting outwardly in all directions in the median plane of said protective tooth a greater distance than immediately adjacent ones of said heat conducting teeth, each pair of immediately adjacent protective teeth having at least portions of two of said heat conducting teeth positioned in the space between them, with only one of the exposed heating surfaces of each of said two heat conducting teeth being located within said space, and wherein segments of said heat conducting element comprise the outside surface of said comb between said two heat conducting teeth which are positioned in the space between each pair of immediately adjacent protective teeth, said outer surface of said heat conducting element defining the outside surface of said comb about the entire periphery of each said segment of said heat conducting element, whereby each hank of hair positioned between an adjacent pair of said heat conducting teeth when the comb is in use receives heat from an exposed heating surface of said heat conducting teeth on both sides of said hanks of hair and segments of said heat conducting element are exposed about the entire periphery of said heat conducting element for transmitting heat to hair when the comb is in use.

* * * * *

UNITED STATES PATENT AND TRADEMARK OFFICE

CERTIFICATE OF CORRECTION

PATENT NO. : 4,126,143

DATED : November 21, 1978

INVENTOR(S) : George A. Schroeder

It is certified that error appears in the above-identified patent and that said Letters Patent are hereby corrected as shown below:

Column 6, line 22, "apertures" should be --grooves--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*